US009390838B2

(12) United States Patent
Hopkinson et al.

(10) Patent No.: US 9,390,838 B2
(45) Date of Patent: Jul. 12, 2016

(54) SHIELDED CABLE WITH UTP PAIR ENVIRONMENT

(71) Applicant: CommScope, Inc. of North Carolina, Hickory, NC (US)

(72) Inventors: Wayne C. Hopkinson, Hickory, NC (US); Trent M. Hayes, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 61 days.

(21) Appl. No.: 14/208,185

(22) Filed: Mar. 13, 2014

(65) Prior Publication Data

US 2014/0262425 A1 Sep. 18, 2014

Related U.S. Application Data

(60) Provisional application No. 61/786,754, filed on Mar. 15, 2013.

(51) Int. Cl.
*H01B 11/06* (2006.01)
*H01B 7/18* (2006.01)

(52) U.S. Cl.
CPC ..... *H01B 11/06* (2013.01); *H01B 7/1875* (2013.01)

(58) Field of Classification Search
CPC ..... H01B 11/04; H01B 11/06
USPC ..... 174/113 R, 121 R, 122 R, 124 R
See application file for complete search history.

(56) References Cited

U.S. PATENT DOCUMENTS

| | | | | |
|---|---|---|---|---|
| 3,622,683 | A | 11/1971 | Roberts et al. | |
| 3,634,607 | A * | 1/1972 | Coleman | H01B 7/14 174/108 |
| 3,681,510 | A | 8/1972 | Lemieux | |
| 3,911,200 | A | 10/1975 | Simons et al. | |
| 5,170,010 | A | 12/1992 | Aldissi | |
| 5,796,046 | A | 8/1998 | Newmoyer et al. | |
| 5,952,615 | A * | 9/1999 | Prudhon | 174/113 C |
| 6,255,593 | B1 | 7/2001 | Reede | |
| 6,441,308 | B1 * | 8/2002 | Gagnon | 174/105 R |
| 6,566,605 | B1 | 5/2003 | Prudhon | |
| 6,720,498 | B2 * | 4/2004 | Grogl et al. | 174/122 G |
| 6,747,214 | B2 * | 6/2004 | Goeblmaier et al. | 174/110 R |
| 6,770,819 | B2 | 8/2004 | Patel | |
| 6,875,928 | B1 | 4/2005 | Hayes et al. | |
| 7,208,683 | B2 * | 4/2007 | Clark | 174/110 R |
| 7,405,360 | B2 * | 7/2008 | Clark et al. | 174/113 R |
| 7,411,131 | B2 * | 8/2008 | Stutzman | 174/113 R |
| 7,999,184 | B2 | 8/2011 | Wiebelhaus et al. | |

(Continued)

OTHER PUBLICATIONS

Web Industries, "Superbulk TM," 2012, online advertisement found at www.webindustries.com.

*Primary Examiner* — Chau N Nguyen
(74) *Attorney, Agent, or Firm* — Muncy, Geissler, Olds & Lowe, P.C.

(57) ABSTRACT

A cable includes a spacer surrounding a cable core. The cable core includes four twisted pairs. A separator is disposed amongst the twisted pairs. The separator may be formed with three layers, wherein a middle layer is conductive and outer layers are nonconductive. A jacket surrounds the spacer, and a shielding layer may reside between the jacket and the spacer. The spacer may be formed of plural fibers or a polymer. Preferably, the spacer presents a lower dielectric constant per unit volume than the jacket. The separator may have a tape shape or a plus shape.

17 Claims, 5 Drawing Sheets

(56) References Cited

U.S. PATENT DOCUMENTS

| | | | | |
|---|---|---|---|---|
| 8,759,680 | B2 * | 6/2014 | Patel | 174/113 R |
| 2005/0006132 | A1 | 1/2005 | Clark | |
| 2005/0133246 | A1 | 6/2005 | Parke et al. | |
| 2008/0073106 | A1 | 3/2008 | Brake et al. | |
| 2008/0105449 | A1 | 5/2008 | Kenny et al. | |
| 2008/0251276 | A1 | 10/2008 | Clark et al. | |
| 2010/0108355 | A1 | 5/2010 | Perez et al. | |
| 2013/0014972 | A1 | 1/2013 | Wiebelhaus et al. | |

* cited by examiner

SHIELDED CABLE WITH UTP PAIR ENVIRONMENT

This application claims the benefit of U.S. Provisional Application No. 61/786,754, filed Mar. 15, 2013, which is herein incorporated by reference.

BACKGROUND OF THE INVENTION

1. Field of the Invention

The present invention relates to a twisted pair cable for communication of high speed signals, such as a local area network (LAN) cable. More particularly, the present invention relates to a twisted pair cable having at least one conductive separator between twisted pairs within the cable, which reduces or eliminates the likelihood of transmission errors because of internal crosstalk, and at least one structure surrounding the cable core to reduce or eliminate the likelihood of transmission errors due to alien crosstalk.

2. Description of the Related Art

Along with the greatly increased use of computers for homes and offices, there has developed a need for a cable, which may be used to connect peripheral equipment to computers and to connect plural computers and peripheral equipment into a common network. Today's computers and peripherals operate at ever increasing data transmission rates. Therefore, there is a continuing need to develop a cable, which can operate substantially error-free at higher bit rates, by satisfying numerous elevated operational performance criteria, such as a reduction in internal and alien crosstalk when the cable is in a high cable density application, e.g., routed alongside other cables.

At higher data rates, it has become increasing common to employ conductive shielding layers around the cable core and conductive tapes within the cable core in order to control internal and alien crosstalk.

SUMMARY OF THE INVENTION

The Applicant has appreciated that the close proximity of the conductive shielding layer surrounding the cable core can potentially degrade the electrical performance of the twisted pairs of the cable at high data rates. For example, the twisted pairs may suffer increased signal attenuation, which can complicate the cable design to meet performance criteria, such as insertion loss, matching impedance, reducing propagation delay and/or balancing delay skew between twisted pairs.

Further, the Applicant has appreciated that the close proximity of conductive tapes within the cable core to shield twisted pairs of the cable core from other twisted pairs within the cable core can potentially degrade the electrical performance of the twisted pairs of the cable at high data rates. For example, the twisted pairs may suffer increased signal attenuation, which can complicate the cable design to meet performance criteria, such as insertion loss, matching impedance, reducing propagation delay and/or balancing delay skew between twisted pairs.

The Applicant appreciated that unshielded twisted pair (UTP) cables generally do not suffer signal attenuation to the degree of shielded twisted pair cables. However, UTP cables perform poorly at higher data transmission rates because internal and alien crosstalk are more problematic.

Hence, a new cable structure is needed in the art as the data transmission rates are increased.

The Applicant has invented a twisted pair cable with new structural features, the object of which is to enhance one or more performance characteristics of a LAN cable, such as reducing internal and alien crosstalk, insertion loss, matching impedance, reducing propagation delay and/or balancing delay skew between twisted pairs, and/or to enhance one or more mechanical characteristics of a LAN cable, such as improving flexibility, reducing weight, reducing cable diameter and/or reducing smoke emitted in the event of a fire.

These and other objects are accomplished by a cable that includes a spacer surrounding a cable core. The cable core includes four twisted pairs. A separator is disposed amongst the twisted pairs. The separator may be formed with three layers, wherein a middle layer is conductive and outer layers are nonconductive. A jacket surrounds the spacer, and a shielding layer may reside between the jacket and the spacer. The spacer may be formed of plural fibers or a polymer. Preferably, the spacer presents a lower dielectric constant per unit volume than the jacket. The separator may have various shapes to include a tape shape, a plus shape and a star shape.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION OF EMBODIMENTS OF THE INVENTION

Figure 1:
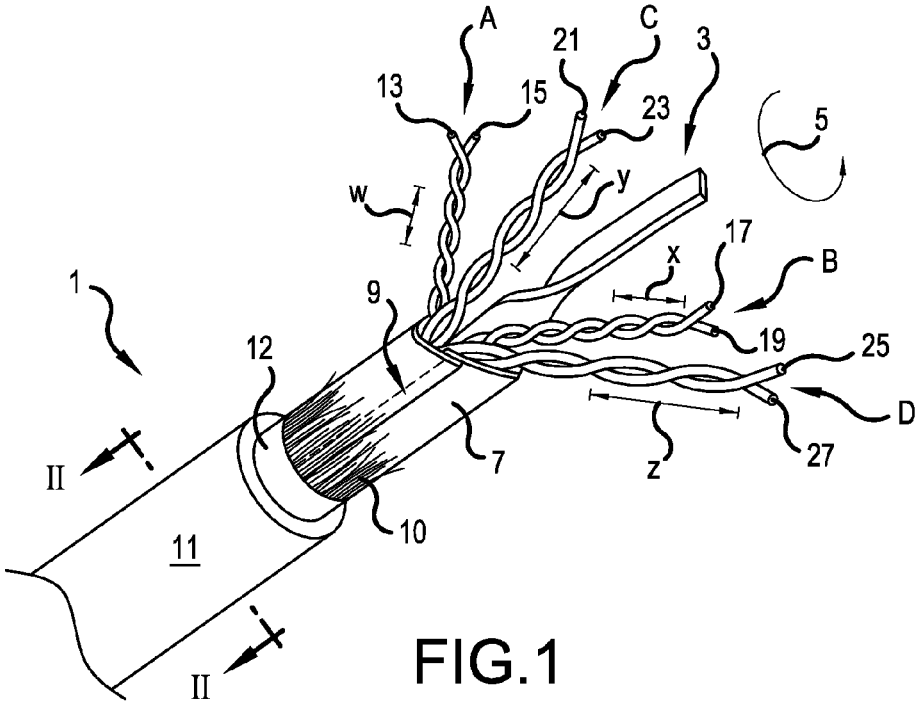
FIG. 1 is a perspective view of a shielded, twisted pair cable, in accordance with a first embodiment of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Figure 2:
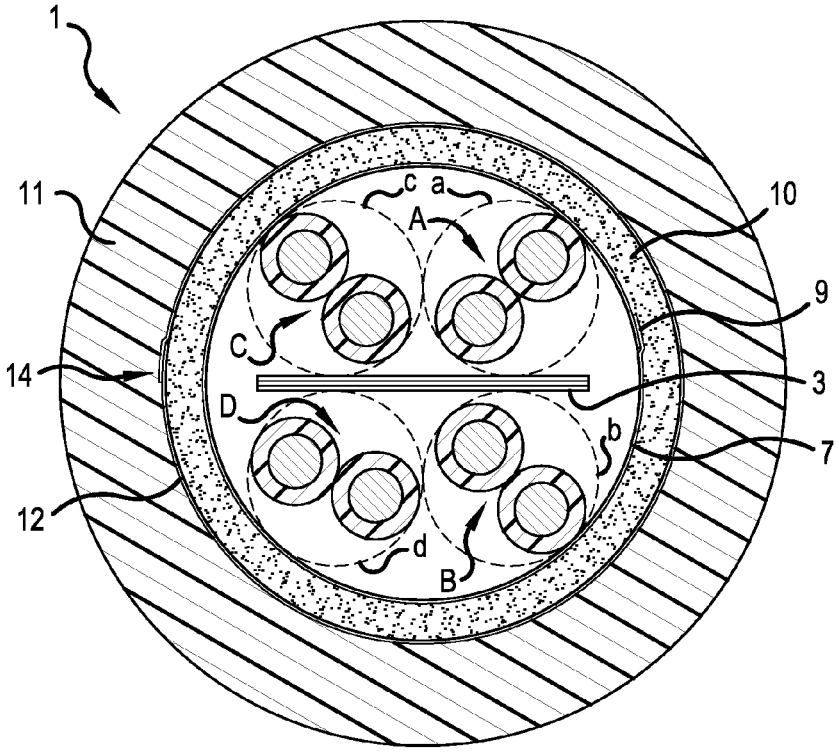
FIG. 2 is a cross sectional view taken along line II-II in FIG. 1.

FIG. 1 is a perspective view of a twisted pair cable 1, in accordance with a first embodiment of the present invention. FIG. 2 is a cross sectional view of the cable 1 taken along line II-II in FIG. 1. A cable core includes first, second, third and fourth twisted pairs A, B, C and D, respectively. The cable core is surrounded by a wrap or binder 7, such as a paper or Mylar® wrapper (biaxially-oriented polyethylene terephthalate), which is overlapping at area 9, and may optionally be adhered to itself in the overlapping area 9. A spacer 10, depicted as a plurality of fibers, surrounds the binder 7. The plurality of fibers may be formed of polymer strands, nylon strands, or other nonconductive natural or synthetic materials. The fibers may be loose or interconnected in the form of a tape or yard, such as in a lattice structure. One particularly well-suit material would be a polypropylene cable filler sold by Web Industries, Inc. under the trademark Superbulk™.

An outer shielding layer 12 surrounds the spacer 10, e.g., the plurality of fibers. The outer shielding layer 12 may be formed of a conductive foil, or a conductive foil adhered to a nonconductive layer, e.g., a Mylar® layer, for added strength. The edges of the outer shielding layer 12 may partially overlap at area 14.

The cable 1 includes a jacket 11 surrounding the shielding layer 12. The jacket 11 may be formed of polyvinylchloride (PVC), low smoke zero halogen, polyethylene (PE), fluorinated ethylene propylene (FEP), polyvinylidene fluoride (PVDF), ethylene chlorotrifluoroethylene (ECTFE), or other foamed or solid materials common to the cabling art. Preferably, the spacer 10 presents a dielectric constant per unit volume, which is less than a dielectric constant per unit volume of the material forming the jacket 11.

The first twisted pair A includes a first insulated conductor 13 formed by a first insulating material surrounding a first conductor, and a second insulated conductor 15 formed by a second insulating material surrounding a second conductor, wherein said first and second insulated conductors 13 and 15 are twisted about each other to form the first twisted pair A. The dashed line "a" shows the outline of the space occupied by the first twisted pair A in the cable core.

The second twisted pair B includes a third insulated conductor 17 formed by a third insulating material surrounding a third conductor, and a fourth insulated conductor 19 formed by a fourth insulating material surrounding a fourth conductor, wherein said third and fourth insulated conductors 17 and 19 are twisted about each other to form the second twisted pair B. The dashed line "b" shows the outline of the space occupied by the second twisted pair B in the cable core.

The third twisted pair C includes a fifth insulated conductor 21 formed by a fifth insulating material surrounding a fifth conductor, and a sixth insulated conductor 23 formed by a sixth insulating material surrounding a sixth conductor, wherein said fifth and sixth insulated conductors 21 and 23 are twisted about each other to form the third twisted pair C. The dashed line "c" shows the outline of the space occupied by the third twisted pair C in the cable core.

The fourth twisted pair D includes a seventh insulated conductor 25 formed by a seventh insulating material surrounding a seventh conductor, and an eighth insulated conductor 27 formed by an eighth insulating material surrounding an eighth conductor, wherein said seventh and eighth insulated conductors 25 and 27 are twisted about each other to form the fourth twisted pair D. The dashed line "d" shows the outline of the space occupied by the fourth twisted pair D in the cable core.

The twist lengths w, x, y and z of the first, second, third and fourth twisted pairs A, B, C and D may be set as listed in Table 1 below.

TABLE 1

| Twisted Pair | Twist Length | Min. Twist Length | Max Twist Length |
|---|---|---|---|
| A | 0.440 | 0.430 | 0.450 |
| B | 0.410 | 0.400 | 0.420 |
| C | 0.596 | 0.580 | 0.610 |
| D | 0.670 | 0.650 | 0.690 |

For example, a first twist length w of the first twisted pair A may be shorter than a third twist length y of the third twisted pair C, and a second twist length x of the second twisted pair B may be shorter than a fourth twist length z of the fourth twisted pair D. It should be noted that other twist lengths than those listed in Table 1 may be employed while practicing the benefits of the present invention.

The first through eighth insulating materials employed by the first, second, third and fourth twisted pairs A, B, C and D may be formed of a flexible plastic material having flame retardant and smoke suppressing properties, such as a polymer or foamed polymer, common to the cabling art, like fluorinated ethylene propylene (FEP), polyethylene (PE) or polypropylene (PP). A radial thickness of the first through eighth insulating materials would typically be greater than seven mils, such as about tens mils or about eleven mils. The first through eighth conductors employed by the first, second, third and fourth twisted pairs A, B, C and D may be solid or stranded, and may be formed of a conductive metal or alloy, such as copper. In one embodiment, the first through eighth conductors are each a solid, copper wire of about twenty three gauge size.

In one embodiment of the invention, the first and third twisted pairs A and C reside in approximately a first half of the cable 1, and the second and fourth twisted pairs B and D reside in approximately a second half of the cable 1. A region between the first and second halves of the cable 1 defines a middle region.

Figure 3:
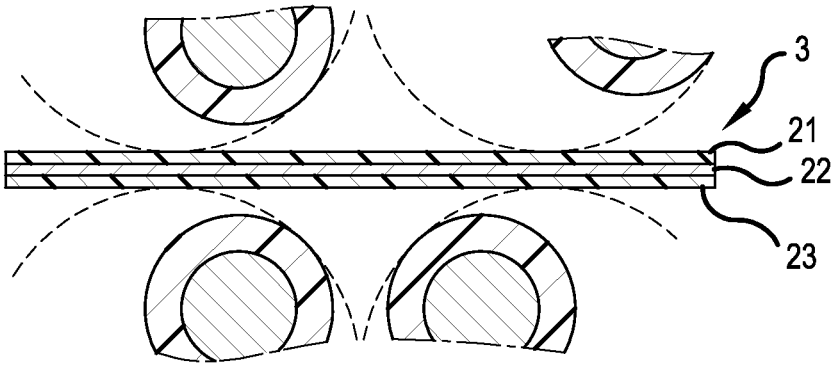
FIG. 3 is a close-up view of a tape separator in FIG. 2.

A separator 3 is located within the cable core and separates the first and third twisted pairs A and C from the second and fourth twisted pairs B and D. As best seen in the close-up view of FIG. 3, the separator tape 3 is constructed as a substantially flat tape and includes at least three layers. A first layer 21 is nonconductive. A second layer 22 is conductive. A third layer 23 is nonconductive. The second layer 22 is located between the first and third layers 21 and 23.

The first and third layers 21 and 23 of the separator 3 may be formed of a polyester film and the second layer may be formed of a conductive foil. One suitable material for the polyester film is biaxially-oriented polyethylene terephthalate, e.g., Mylar®, and one suitable material for the conductive foil is aluminum, although other materials may be selected. Suitable thicknesses might be about 1 mil or less for each of the first, second and third layers 21, 22 and 23. However, to gain better separation of the conductive, second layer 22 from the first through the fourth twisted pairs A, B, C and D, the first and third layers 21 and 23 of the separator 3 may be formed of a polymer, and the first and third layers 21 and 23 may be thicker than the second layer 22, so as to distance the second layer 22 from the first through the fourth twisted pairs A, B, C and D. Likewise, the purpose of the spacer 10 is to distance the first through the fourth twisted pairs A, B, C and D from the outer shielding layer 12. The arrangement creates a "UTP-like" (unshielded twisted pair-like) environment for the cable core, while still retaining the performance benefits of shielding.

As seen in FIG. 1, the cable core may be twisted in the direction of arrow 5 to form a core strand. In the illustrated embodiment, the direction 5 is opposite to the twist directions of the first, second, third and fourth twisted pairs A, B, C and D and may offer advantages as discussed in the Assignee's U.S. Pat. No. 6,770,819, which is incorporated herein by reference. However, this is not a necessary feature, as the benefits of the present invention will still be apparent with the core strand's direction 5 being the same as the pair twist directions. The core strand length may be approximately 2 inches, although other lengths may be employed within the scope of the present invention.

Figure 4:
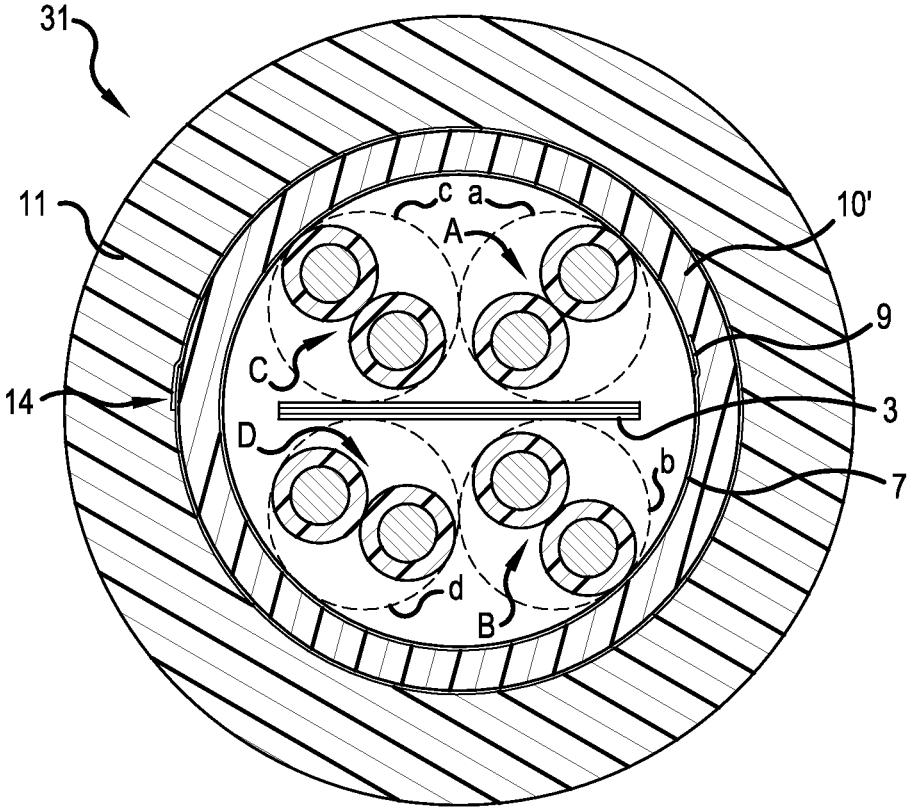
FIG. 4 is a cross sectional view, similar to FIG. 2, but showing a shielded, twisted pair cable, in accordance with a second embodiment of the present invention.

FIG. 4 is a cross sectional view, similar to FIG. 2, but showing a shielded, twisted pair cable 31, in accordance with a second embodiment of the present invention. Like structures have been labeled with the same reference numerals as used in previous embodiment.

In the second embodiment, the spacer 10' is now formed of a polymer material, as opposed to the fibrous material of the first embodiment of FIGS. 1 and 2. In a preferred embodiment, the polymer used to form the spacer 10' is foamed, e.g., filled to some extent with trapped gas pockets. Once again, it is preferred that the spacer 10' present a dielectric constant per unit volume, which is less than a dielectric constant per same unit volume of the material forming the jacket 11. For example, the spacer 10' may be formed of a same polymer material as used to form the jacket 11, if the polymer material of the spacer 10' is foamed to a greater extent than the polymer material used to form the jacket 11. All other aspects of the second embodiment are the same as the first embodiment.

Figure 5:
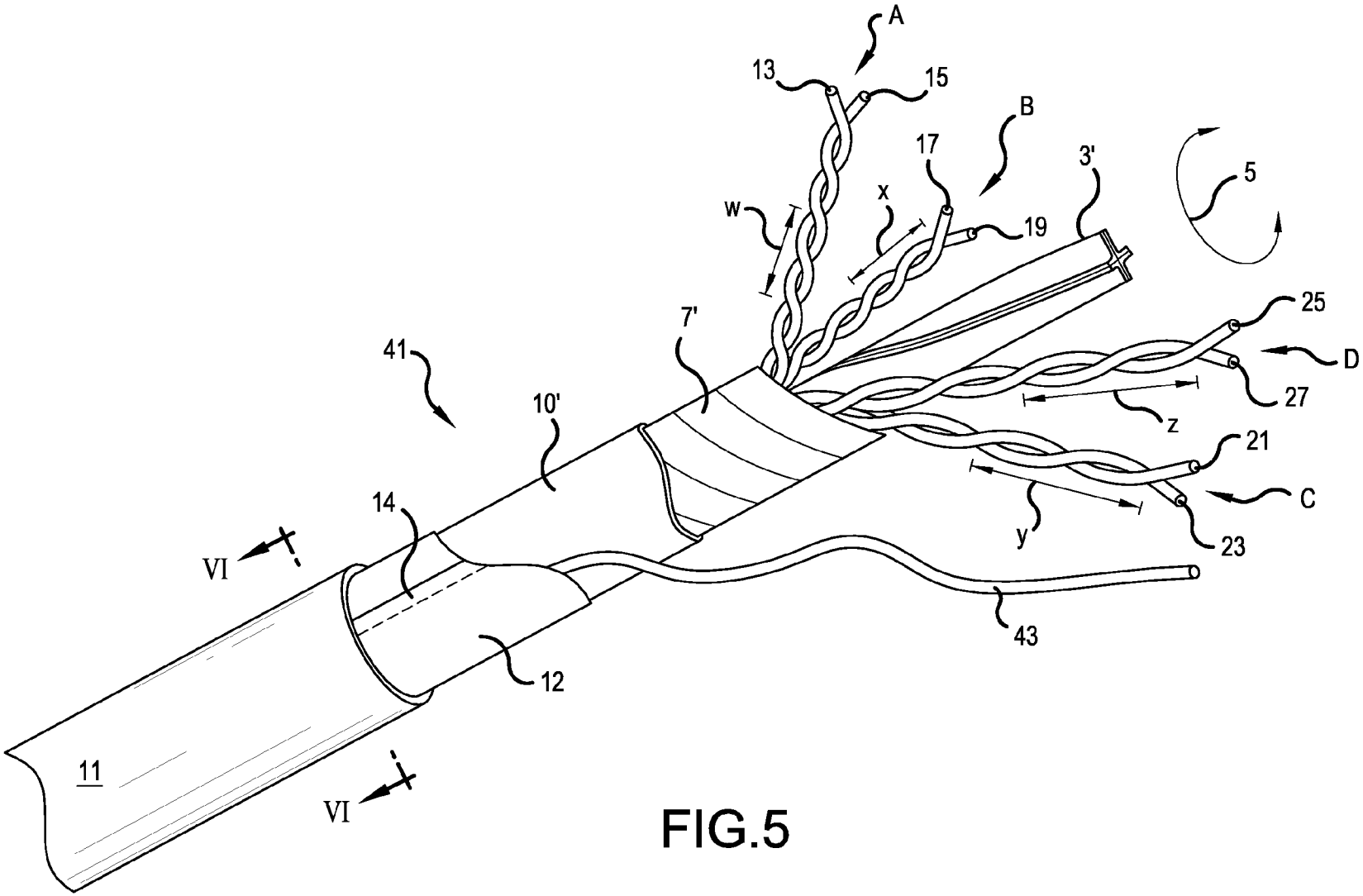
FIG. 5 is a perspective view of a shielded, twisted pair cable, in accordance with a third embodiment of the present invention.
Figure 6:
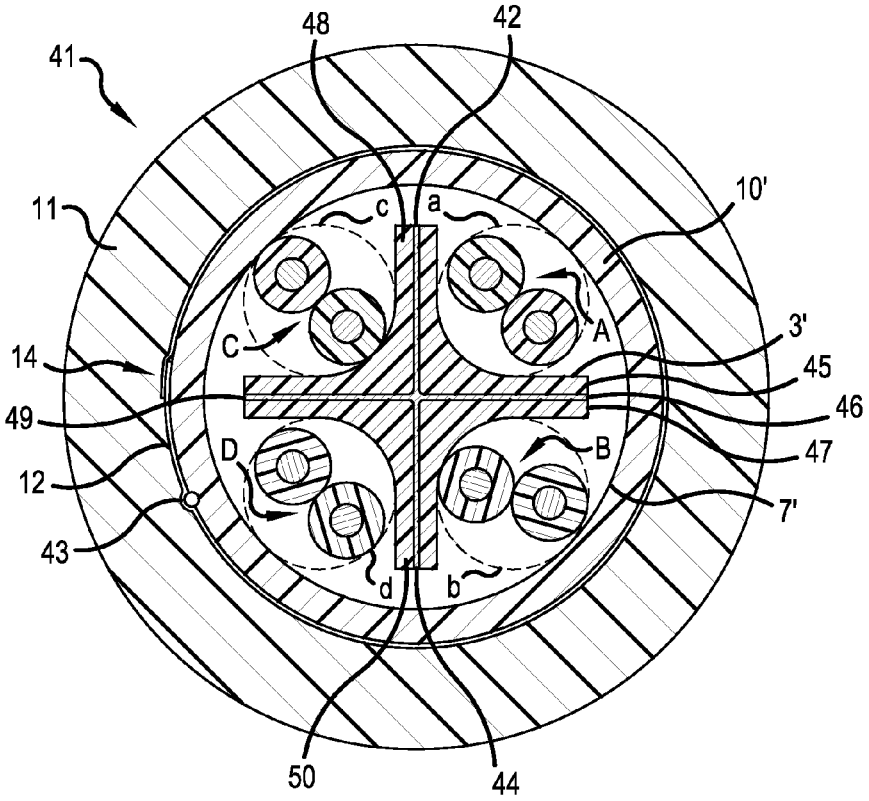
FIG. 6 is a cross sectional view taken along line VI-VI in FIG. 5.

FIG. 5 is a perspective view of a twisted pair cable 41, in accordance with a third embodiment of the present invention. FIG. 6 is a cross sectional view of the cable 41 taken along line VI-VI in FIG. 5. Like structures have been labeled with the same reference numerals as used in previous embodiments.

In the third embodiment, the spacer 10' is again formed of a polymer material, as depicted in the second embodiment. A drain wire 43 directly contacts the outer shielding layer 12. In the drawings, the drain wire 43 is located in direct contact with the inside surface of the outer shielding layer 12, however the drain wire 43 could also be located in direct contact with the outside surface of the outer shielding layer 12.

In the third embodiment, the separator 3' is formed in cross section as a star-shaped or plus-shaped member. The separator 3' separates the first and third twisted pairs A and C from the second and fourth twisted pairs B and D. However, the separator 3' also separates the first and second twisted pairs A and B from the third and fourth twisted pairs C and D. In other words, the separator 3' separates the first twisted pair A from the second, third and fourth twisted pairs B, C and D, and separates the second twisted pair B from the third and fourth twisted pairs C and D, and separates the third twisted pair C from the fourth twisted pair D.

Again, the separator 3' includes at least three layers, with a first layer 45 being nonconductive, a second layer 46 being conductive, and a third layer 47 being nonconductive. The second layer 46 is located between the first and third layers 45 and 47. In the case of the plus-shaped separator 3' of FIG. 6, the separator also includes a fourth layer 48 being nonconductive, a fifth layer 49 being conductive, and a sixth layer 50 being nonconductive. The fifth layer 49 is located between the fourth and sixth layers 48 and 50. A seventh conductive layer 42 resides between the first nonconductive layer 45 and the fourth nonconductive layer 48. An eighth conductive layer 44 resides between the third nonconductive layer 47 and the sixth nonconductive layer 50.

FIGS. 5 and 6 also illustrate a modified binder 7'. The binder 7' is a helically wrapped paper or similar flexible sheet material. The binder 7' may include slight overlaps about the helical windings and the overlaps may optionally be adhered to each other. The binders 7 and 7' are more advantageous in the embodiments of the present invention where the spacer 10 is formed of plural fibers. In such embodiments, the binders 7 and 7' assist in keeping the fibers of the spacer 10 out of the cable core. In the embodiments wherein the spacer 10' is formed of a solid polymer material, the binders 7 and 7' could be considered more of an optional structure.

Figure 7:
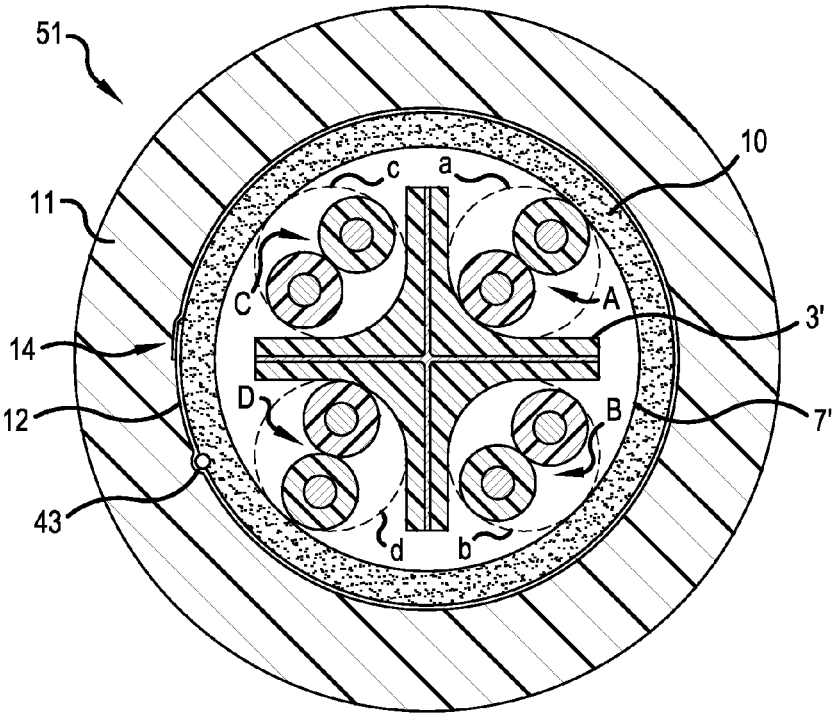
FIG. 7 is a cross sectional view, similar to FIG. 6, but showing a shielded, twisted pair cable, in accordance with a fourth embodiment of the present invention.

FIG. 7 is a cross sectional view, similar to FIG. 6, but showing a shielded, twisted pair cable 51, in accordance with a fourth embodiment of the present invention. Like structures have been labeled with the same reference numerals as used in previous embodiments.

In the fourth embodiment, the spacer 10 is again formed of plural fibers, as depicted in the first embodiment. All other aspects of the fourth embodiment are the same as the third embodiment.

It would be possible to leave the outer shielding layer 12 out of the first through fourth embodiments of the invention. Should alien crosstalk be of lower concern, e.g., in the instance where the cable is not to be routed alongside adjacent twisted pair cables, or in an area not susceptible to electromagnetic interference (EMF), then an outer shielding layer 12 may not be required, and hence manufacturing costs may be reduced. Each of the embodiments discussed above may be employed without the outer shielding layer 12 where alien crosstalk is not considered problematic.

The alien crosstalk performance in the above described embodiments could alternatively or additionally be enhanced by employing a striated spacer 10 and/or jacket 11, as shown in U.S. Pat. No. 5,796,046 and published U.S. Application 2005/0133246, both of which are herein incorporated by reference. The alien crosstalk performance could be further enhanced by employing twist modulation and/or core strand modulation, as shown in the Assignee's U.S. Pat. No. 6,875,928, which is incorporated herein by reference.

Figure 8:
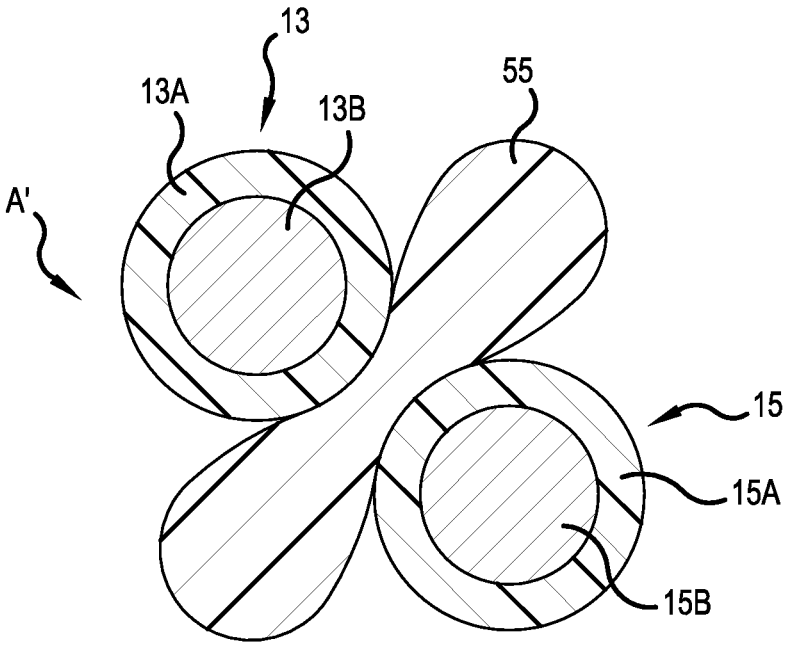
FIG. 8 is a cross sectional view showing an alternative twisted pair structure, which may be substituted in the above embodiments.

FIG. 8 is a cross sectional view showing an alternative twisted pair A' which allows insulation layers 13A and 15A surrounding conductors 13B and 15B to be made thinner (e.g., less than 7 mils, such as 5 or 6 mils in radial thickness), which can lead to improvements in cable performance as detailed in the Assignee's prior U.S. Pat. No. 7,999,184, which is incorporated herein by reference. One, two, three or all of the first, second, third and fourth twisted pairs A, B, C and D may be replaced with the twisted pair configuration illustrated in FIG. 8, which includes an interposed dielectric tape 55. Although FIG. 10 depicts a particular shape for the dielectric tape 55, other shapes may be employed, such as those shown in the above mentioned U.S. Pat. No. 7,999,184.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

We claim:

1. A cable comprising:

a first conductor; a first insulating material surrounding said first conductor to form a first insulated conductor; a second conductor; and a second insulating material surrounding said second conductor to form a second insulated conductor, wherein said first and second insulated conductors are twisted about each other to form a first twisted pair;

a third conductor; a third insulating material surrounding said third conductor to form a third insulated conductor; a fourth conductor; and a fourth insulating material surrounding said fourth conductor to form a fourth insulated conductor, wherein said third and fourth insulated conductors are twisted about each other to form a second twisted pair;

a fifth conductor; a fifth insulating material surrounding said fifth conductor to form a fifth insulated conductor; a sixth conductor; and a sixth insulating material surrounding said sixth conductor to form a sixth insulated conductor, wherein said fifth and sixth insulated conductors are twisted about each other to form a third twisted pair;

a seventh conductor; a seventh insulating material surrounding said seventh conductor to form a seventh insulated conductor; an eighth conductor; and an eighth insulating material surrounding said eighth conductor to form an eighth insulated conductor, wherein said seventh and eighth insulated conductors are twisted about each other to form a fourth twisted pair;

a spacer surrounding said first, second, third and fourth twisted pairs, wherein said first and third twisted pairs reside in approximately a first half of said cable, and said second and fourth twisted pairs reside in approximately a second half of said cable, and wherein a region between said first and second halves of said cable defines a middle region;

a separator disposed proximate said middle region to separate said first and third twisted pairs from said second and fourth twisted pairs, said separator including at least three layers, with a first layer being nonconductive, a second layer being conductive, and a third layer being nonconductive, wherein said second layer is located between said first and third layers;

a shielding layer surrounding said spacer; and a jacket surrounding said shielding layer, wherein said shielding layer is disposed between said jacket and said spacer, and wherein said spacer is formed of plural loose fibers.

2. The cable according to claim 1, wherein said spacer has a dielectric constant per unit volume which is less than a dielectric constant per same unit volume of said jacket.

3. The cable according to claim 1, further comprising:

a drain wire directly contacting said shielding layer.

4. The cable according to claim 1, wherein said first and third layers of said separator are formed of a polyester film and said second layer is formed of conductive foil.

5. The cable according to claim 1, wherein said first and third layers of said separator are formed of a polymer and said second layer is formed of conductive foil.

6. The cable according to claim 1, wherein said separator is shaped as a flat tape.

7. The cable according to claim 1, wherein said separator is formed in cross section as a star-shaped or plus-shaped member and also separates said first and second twisted pairs from said third and fourth twisted pairs.

8. The cable according to claim 1, wherein a first dielectric tape is interposed between said first insulated conductor and said second insulated conductor, as said first and second insulated conductors are twisted about each other to form said first twisted pair;

wherein a second dielectric tape is interposed between said third insulated conductor and said fourth insulated conductor, as said third and fourth insulated conductors are twisted about each other to form said second twisted pair;

wherein a third dielectric tape is interposed between said fifth insulated conductor and said sixth insulated conductor, as said fifth and sixth insulated conductors are twisted about each other to form said third twisted pair; and wherein a fourth dielectric tape is interposed between said seventh insulated conductor and said eighth insulated conductor, as said seventh and eighth insulated conductors are twisted about each other to form said fourth twisted pair.

9. A cable comprising:

a first twisted pair;

a second twisted pair;

a third twisted pair;

a fourth twisted pair;

a spacer surrounding said first, second, third and fourth twisted pairs; and a jacket surrounding said spacer, wherein said spacer has a dielectric constant per unit volume which is less than a dielectric constant per same unit volume of said jacket, and wherein said spacer is formed of plural loose fibers, wherein said first and third twisted pairs reside in approximately a first half of said cable, and said second and fourth twisted pairs reside in approximately a second half of said cable, and a region between said first and second halves of said cable defines a middle region, and further comprising:

a separator disposed proximate said middle region to separate said first and third twisted pairs from said second and fourth twisted pairs, wherein said separator includes at least three layers, with a first layer being nonconductive, a second layer being conductive, and a third layer being nonconductive, and wherein said second layer is located between said first and third layers.

10. The cable according to claim 9, further comprising:

a shielding layer disposed between said jacket and said spacer.

11. The cable according to claim 9, wherein said separator also separates said first twisted pair from said second, third and fourth twisted pairs, and separates said second twisted pair from said third and fourth twisted pairs, and separates said third twisted pair from said fourth twisted pair.

12. A cable comprising:

a first twisted pair;

a second twisted pair;

a third twisted pair;

a fourth twisted pair;

a binder surrounding said first, second, third and fourth twisted pairs;

a spacer surrounding said binder, wherein said first and third twisted pairs reside in approximately a first half of said cable, and said second and fourth twisted pairs reside in approximately a second half of said cable, wherein a region between said first and second halves of said cable defines a middle region;

a separator disposed proximate said middle region to separate said first and third twisted pairs from said second and fourth twisted pairs, wherein said separator includes at least three lavers, with a first layer being nonconductive, a second layer being conductive, and a third layer being nonconductive, wherein said second layer is located between said first and third lavers; and a jacket surrounding said spacer, wherein said spacer has a dielectric constant per unit volume which is less than a dielectric constant per same unit volume of said jacket, wherein said spacer is formed of plural loose fibers.

13. The cable according to claim 12, further comprising:

a shielding layer surrounding said spacer and being disposed between said jacket and said spacer.

14. The cable according to claim 12, wherein said first and third layers of said separator are formed of a polyester film and said second layer is formed of conductive foil.

15. The cable according to claim 12, wherein said first and third layers of said separator are formed of a polymer and said second layer is formed of conductive foil.

16. The cable according to claim 12, wherein said separator is shaped as a flat tape.

17. The cable according to claim 12, wherein said separator is formed in cross section as a star-shaped or plus-shaped member and also separates said first and second twisted pairs from said third and fourth twisted pairs.

* * * * *